United States Patent [19]

Pritchett

[11] Patent Number: 4,617,612

[45] Date of Patent: Oct. 14, 1986

[54] HIGH EFFICIENCY TASK LIGHTING FIXTURE

[76] Inventor: John C. Pritchett, 4777 Enders Rd., Manlius, N.Y. 13104

[21] Appl. No.: 693,355

[22] Filed: Jan. 22, 1985

[51] Int. Cl.[4] ..... F21M 3/20; F21V 7/14

[52] U.S. Cl. ..... 362/33; 362/216; 362/282; 362/398; 362/346

[58] Field of Search ..... 362/33, 97, 133, 216, 362/217, 220, 260, 277, 282, 296, 297, 341, 346, 365, 368, 398, 269, 232, 319, 322

[56] References Cited

U.S. PATENT DOCUMENTS

| | | | |
|---|---|---|---|
| 2,433,241 | 12/1947 | Schwarzmayr | 362/282 |
| 4,300,185 | 11/1981 | Wakamatsu | 362/33 |
| 4,337,507 | 6/1982 | Lasker | 362/282 |
| 4,344,111 | 8/1982 | Ruud et al. | 362/33 |
| 4,383,289 | 5/1983 | Lewin | 362/33 |
| 4,422,134 | 12/1983 | Brass | 362/33 X |
| 4,432,044 | 2/1984 | Lautzenheiser | 362/33 X |
| 4,455,593 | 6/1984 | Martino et al. | 362/282 X |
| 4,535,395 | 8/1985 | Prester | 362/398 X |

*Primary Examiner*—Willis R. Wolfe, Jr.
*Attorney, Agent, or Firm*—James E. Schardt

[57] ABSTRACT

A task light fixture adapted for magnetic attachment to the underside of a shelf or cabinet above a work surface, the fixture having a reflector adapted to produce an asymmetric beam of light directed toward the work surface, the reflector being rotatable about a vertical axis to direct the light to various areas of the work surface.

4 Claims, 5 Drawing Figures

HIGH EFFICIENCY TASK LIGHTING FIXTURE

BACKGROUND OF THE INVENTION

In recent years, the design of modern offices has changed dramatically. Current office design most often utilizes free standing work modules which can be readily modified to meet the changing demands of the business rather than the traditional arrangement having private offices with permanent partitions and a large open work space for those workers who do not require a quiet, private office. This change in office design has coincided with current recognition of the need for energy conservation. Therefore, rather than provide high levels of illumination from ceiling fixtures, the current trend is to provide low level room illumination and individually controlled high level task lighting for desks or work stations.

Commercially available modular work stations are designed such that the work surface or "desk" top is built into or attached to the free standing partitions that define the individual work stations. It is common with these units to also employ book shelves or storage units above the desk area. Lighting fixtures, usually strip fluorescents, are installed under these storage units to provide high intensity task lighting for the work surface.

For optimal working conditions, the task lighting must produce glare-free, even lighting at the work surface. Light from the fixture must also be prevented from shining into the worker's eyes.

A number of lighting fixtures have been proposed to accomplish these ends such as U.S. Pat. Nos. 4,054,793 (Shemitz), 4,161,767 (Benasutti), and 4,383,289 (Lewin). U.S. Pat. Nos. 2,240,179 and 2,560,281 (Doane) while not directly concerned with task lighting, disclose fixtures for uniformly illuminating the area beneath the fixtures. However, none of these fixtures are completely satisfactory. Those that use diffusers between the light source and the work surface, of necessity, lose a proportion of the light energy in the diffuser. Those that use a reflector behind the light source to direct the light toward the work surface either do not provide even illumination or result in a lighting pattern that is fixed and may not be suitable for varying tasks that might be performed on the work surface.

It is therefore the object of this invention to provide a light fixture that is highly efficient in directing light from the light source to a work surface in a very even, glare-free manner. Further, the fixture is worker adjustable to allow variation of the light pattern over a broad range to accommodate lighting requirements of a wide range of tasks.

SUMMARY OF THE INVENTION

This invention relates to an adjustable lamp fixture for providing even, glare-free illumination of a work surface including a housing having a top wall, the upper surface thereof being adapted for mounting in a stationary position above the work surface, the housing having a bottom wall with a circular opening therein. A light concentrating, open reflector is provided, the lower edges thereof having a circular flange thereon adapted for mating engagement with the edges of the circular opening in the bottom wall of the housing such that the reflector may be manually rotated relative to the housing. Socket means are provided on the reflector for mounting an elongated lamp therein for rotation with the reflector.

DESCRIPTION OF THE PREFERRED EMBODIMENT

Figure 1:
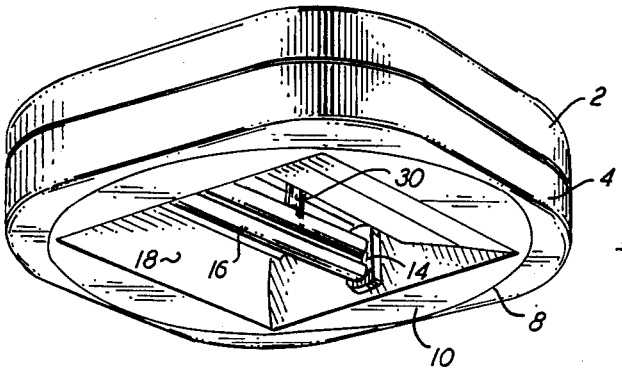
FIG. 1 is a perspective view of the task lamp fixture of the present invention suitable for mounting under an overhead storage cabinet or bookshelf above a work surface to be illuminated.
Figure 2:
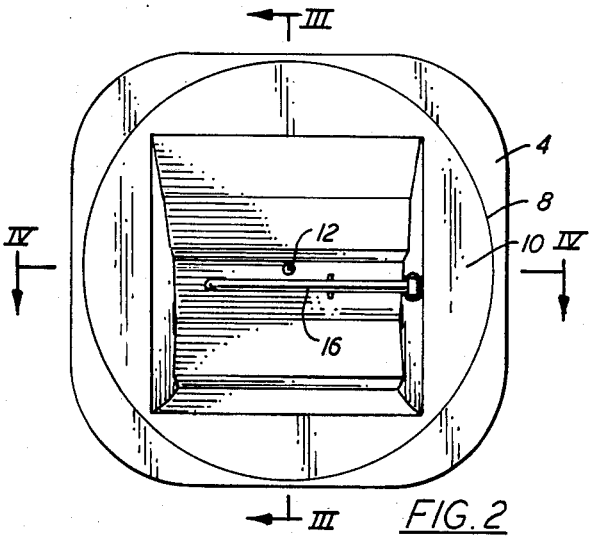
FIG. 2 is a bottom view of the fixture of FIG. 1.

Referring to FIGS. 1–4 of the drawings there is illustrated a lighting fixture including a housing having a top section 2 and a bottom section 4. Since the lighting fixture is designed primarily for use with modular office equipment having overhead storage units or bookshelves, which are ordinarily made of steel, a magnetic plate 6 may be permanently affixed to the top surface of housing section 2 by suitable means such as a pressure sensitive adhesive. Preferably, the plate 6 is a flexible magnet, which is a ferromagnetic material with properties similar to iron, held in place with a thermoplastic binder. It is a non-porous, homogeneously magnetic sheet which is a permanent magnet. Through the use of a magnetic plate, the housing may be mounted under the storage unit simply by placing the unit in the desired location. If the storage unit or overhead shelf is made of a non-magnetic material, a steel plate may be provided for mounting under the shelf storage unit by suitable means such as screws, rivets or adhesive to allow the fixture to be magnetically attached to the plate.

Bottom section 4, which is adapted for mating engagement with top housing section 2, is provided with a circular opening 8 therein. A reflector 10, the novel reflecting surface of which will be described in detail hereinafter, is provided with a circular lower flange adapted for mating engagement with bottom section 4 to allow rotational movement of the reflector 10 relative to the fixture housing. If desired, fastener means such as rivets or a screw 12 may be utilized to rotatably secure reflector 10 to the top section 2. Socket means 14 are provided for mounting an elongated lamp 16 in reflector 10. A suitable lamp for use with the disclosed fixture is the compact energy saving fluorscent Model PL lamp manufactured by North American Philips Lighting Corporation or a Model TT lamp manufactured by Sylvania Corporation. The surfaces of reflector 10 are designed to provide maximum efficiency with a lamp of this type while providing an even, glare-free illumination of the work area associated with the lamp. To this end, the reflector is provided with a first, generally vertical, arcuate section 18, the concave surface of which is adapted to produce an asymmetric beam of light perpendicular to the axis of the lamp and opposite the generally vertical arcuate section to reflect light from the lamp 16 back toward the lamp but in a generally downward direction toward the work surface. Second and third, substantially planar sections 20 and 22, located generally above the lamp 16, are provided with reflecting surfaces to direct light from the lamp 16 both left and right of the lamp in a generally downward direction.

A connecting section 24 is provided between section 18 and sections 20 and 22. A fourth reflecting section 26 and a fifth reflecting section 28 adjacent section 22 are disposed at a relatively shallow angle relative to the bottom surface of the fixture to direct light from the lamp in the same general direction as the reflector section 18 toward the work station or surface below the light fixture.

To assure that the lamp is precisely located relative to the various reflecting sections, a lamp positioning projection 30 is provided on reflector section 22. This projection is sized and located such that when a lamp is inserted into the socket means 14, a slight interference between the lamp and the bottom edge of the projection will positively position the lamp in the reflector.

By utilizing the reflector descrbed with a lamp mounted as illustrated, an extremely even pattern of glare-free light is provided to the work surface without requiring diffusers which reduce the overall effectiveness of the energy saving lamp.

By providing a lamp-reflector assembly which may be rotated relative to a permanently or semi-permanently installed fixture, the location of the highly illuminated area on the work surface may be varied as the worker's tasks change. For example, if the worker is using a computer terminal, the illuminated area may be directed away from the computer screen to reduce glare and render the screen easier to see. The reflector-lamp assembly could alternately be adjusted to provide an area of illumination directly in front of the worker if the worker needed to read documents or write at the work station.

Figure 5:
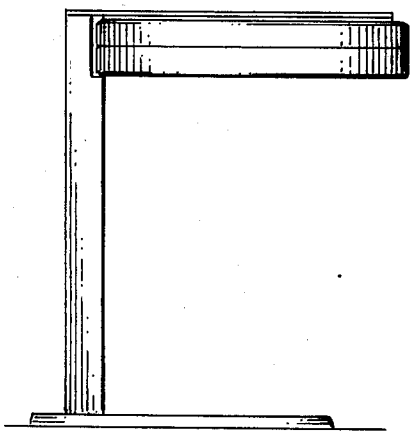
FIG. 5 is a side view of a fixture similar to the fixture of FIG. 1 mounted on a stand as a free standing desk lamp.
Figure 3:
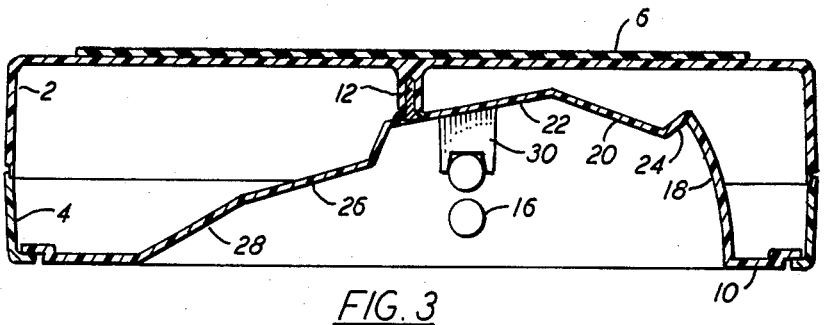
FIG. 3 is a sectional view taken along line III—III of FIG. 2.
Figure 4:
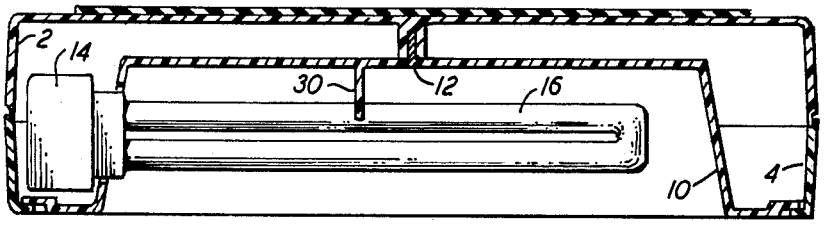
FIG. 4 is a sectional view taken along line IV—IV of FIG. 2.

FIG. 5 illustrates another embodiment of my invention wherein the basic fixture is mounted on a short stand to allow use of the fixture as a desk lamp in those instances where a component such as a storage compartment or bookshelf is not available for mounting the fixture of FIGS. 1–4. It should also be understood that other suitable means such as a floor type stand or wall mounting means could be utilized to provide a floor or wall lamp using the basic fixture described.

While I have described a preferred embodiment of my invention, it should be understood that the invention is not limited thereto but may be otherwise embodied within the scope of the following claims.

I claim:

1. An adjustable lamp fixture comprising a housing having a top wall and a bottom wall parallel to said top wall, said bottom wall having a circular opening therein;

a light concentrating, asymmetric open reflector having a circular flange thereon adapted for mating engagement with said bottom wall for rotatably mounting said reflector in said bottom wall to allow rotational adjustment of said reflector relative to said housing about an axis perpendicular to said bottom wall while maintaining said flange parallel to said bottom wall; and, socket means adapted for receiving an elongated lamp for mounting said lamp in a position such that the longitudinal axis of the lamp is parallel with the bottom wall of said housing.

2. An adjustable lamp fixture according to claim 1 wherein said reflector is provided with a generally vertical arcuate section, said socket being positioned in said reflector such that an elongated lamp mounted in said socket is positioned to produce an asymmetric beam of light parallel to the lamp axis and opposite the generally vertical arcuate section.

3. An adjustable lamp fixture according to claim 1 wherein said reflector is provided with a first, generally vertical arcuate section, the concave surface of which is positioned to reflect light from the elongated lamp mounted in said socket back toward the lamp in a generally downward direction, said reflector having second and third substantially planar sections above the lamp to direct light from the lamp both left and right of the lamp in a generally downward direction and fourth and fifth substantially planar sections disposed at a relatively shallow angle relative to the bottom wall of said housing to direct light in the same general direction as said first reflector section, said reflector sections being adapted to direct light from an elongated lamp mounted in said socket in a generally downward direction to provide high intensity, even, glare free illumination.

4. An adjustable lamp fixture according to claim 3 wherein said reflector is provided with downwardly projecting lamp engagement means to position said lamp relative to the reflecting surfaces of said reflector.

* * * * *